US012742316B2

(12) United States Patent
Yang et al.

(10) Patent No.: US 12,742,316 B2
(45) Date of Patent: Sep. 22, 2026

(54) FAUCET SUPPORT ASSEMBLY

(71) Applicant: Globe Union Industrial Corp., Taichung City (TW)

(72) Inventors: Chao-Ta Yang, Taichung City (TW); Yuan-Hao Chang, Taichung City (TW)

(73) Assignee: GLOBE UNION INDUSTRIAL CORP., Taichung City (TW)

( * ) Notice: Subject to any disclaimer, the term of this patent is extended or adjusted under 35 U.S.C. 154(b) by 0 days.

(21) Appl. No.: 19/205,765

(22) Filed: May 12, 2025

(65) Prior Publication Data

US 2026/0062900 A1 Mar. 5, 2026

(30) Foreign Application Priority Data

Sep. 2, 2024 (CN) ..... 202422139218.7

(51) Int. Cl.
*E03C 1/04* (2006.01)

(52) U.S. Cl.
CPC .... *E03C 1/0402* (2013.01); *E03C 2001/0415* (2013.01)

(58) Field of Classification Search
CPC ..... E03C 1/0402; E03C 1/0401; E03C 2001/0415
See application file for complete search history.

(56) References Cited

U.S. PATENT DOCUMENTS

| | | | | |
|---|---|---|---|---|
| 6,334,226 | B1 * | 1/2002 | Tokunaga | E03C 1/0402 4/678 |
| 8,776,355 | B2 * | 7/2014 | Reiman | E03C 1/0402 4/678 |
| 10,030,370 | B1 * | 7/2018 | Xiao | E03C 1/0402 |
| 2019/0284785 | A1 * | 9/2019 | Mu | E03C 1/0402 |

* cited by examiner

*Primary Examiner* — P. Macade Nichols
(74) *Attorney, Agent, or Firm* — LANWAY IPR SERVICES; Chun-Ming Shih

(57) ABSTRACT

A faucet support assembly is provided. The faucet support assembly includes a support member, two threaded rods, and two pressing blocks. The support member consists of a seat and a support leg. The support leg is provided with two rotation limit rods connected to the seat and a separation portion connected to bottoms of the rotation limit rods. A separation hole is disposed on the separation portion for allowing a pull-out tube under a faucet to insert through. The threaded rod is rotatable and pivotally connected to the seat and the limit hole of the separation portion. The pressing blocks is engaged with the threaded rod by threads and limited by the adjacent rotation limit rod while being extended. The pressing block is moved along the threaded rod and pressed on a bottom surface of a tabletop. Thereby the support member is operated smoothly and assembled firmly.

11 Claims, 11 Drawing Sheets

FAUCET SUPPORT ASSEMBLY

FIELD OF THE INVENTION

The present invention relates to a fixing part for faucets, especially to a support assembly able to be installed on a tabletop and further fixing faucets thereon.

BACKGROUND OF THE INVENTION

As is known to all, a conventional faucet is having a bottom-mount design, being installed from a bottom of a tabletop. Such installation way has a plurality of shortcomings. Thus a plurality of top-mount faucets is provided. Refer to U.S. Pat. No. 6,334,226B1, a faucet support member is provided. A faucet support member for fixing a faucet in a mounting hole made in a base plate or a table top. The faucet support member includes a support seat which is provided to support a base end portion of the faucet, tightening members fixed to the support seat by connectors and pivotable with the connectors and slidable along the connectors, and members for preventing the tightening members from being turned further. The tightening member can be inserted into the mounting hole when the front end portions thereof are directed inward, and open beyond the diameter of the mounting hole when the front end portions of the tightening members are directed outward. The tightening members opening beyond the diameter of the mounting hole are moved toward a bottom surface of the support seat to hold the base plate between the bottom surface of the support seat and an upper surface of the tightening members and support the faucet on the base plate.

The faucet support member mentioned above is especially suitable for a pull-out faucet or a pull-down faucet with a spray head able to be pulled out and extended manually according to user's needs. The faucet support member is installed on the base plate. An opening inside the support seat is used to allow four water pipelines under the faucet to pass through from top to bottom. The four water pipelines consist of a cold-water intake pipe, a hot-water intake pipe, a pull-out tube, and a mixed water discharge pipe. The opening is designed to have a larger hole and a smaller hole communicating with each other. The larger hole is used for allowing the cold-water intake pipe, the hot-water intake pipe, and the mixed water discharge pipe to pass through while the smaller hole is allowing only the pull-out tube to pass through. The movable pull-out tube is separated from other static pipes as much as possible in order to avoid mutual interference.

However, the design of the above support member still has certain shortcomings. For example, the larger hole and the smaller hole are still communicating with each other. There is no special design used for preventing the pull-out tube inserted through and mounted in the smaller hole from moving toward the larger hole. This means that during installation or the following use, the pull-out tube may be still in contact with other static pipes. Thus each time the user pulls and operates the spray head, the pull-out tube may have friction with other static pipes. Therefore, the operation of the spray head is getting harder or less smooth. The long-term abrasion may also affect service life of the pipes.

Moreover, the connectors are separated so that their structural strength is lower. While being collided accidentally, the connectors are easy to have bending, deformation, tilting, or damages. The smoothness of threading between the tightening members and the connectors and attachment of the tightening member to the bottom surface of the base plate are both further affected. The above problems will get worse especially when longer connectors are used to mount the base plate with larger thickness. Thus there is room for improvement and there is need to provide a faucet support member with novel design.

SUMMARY

Therefore, it is a primary object of the present invention to provide a faucet support assembly which provides better structural strength and avoids deformation or damages caused by collision to ensure operation smoothness and firmness during installation. Moreover, a spray head disposed on the faucet can be operated smoothly in a labor-saving manner and service life of respective water pipelines is ensured.

In order to achieve the above object, a faucet support assembly according to the present invention is provided and installed on a tabletop with a mounting hole. The faucet support assembly includes a support member, two threaded rods, and two pressing blocks.

The support member consists of a seat mounted on a top surface of the tabletop around the mounting hole and a support leg integrally extending downward from a bottom of the seat and passed through the mounting hole. The seat is provided with a mounting though hole and two insertion holes. The support leg is provided with two rotation limit rods each of which having a top connected to the seat, a separation portion connected to and located between bottoms of the rotation limit rods, a separation hole defined by the separation portion, and two limit holes each of which is located adjacent to the corresponding rotation limit rod and defined by the separation portion.

Each of the threaded rods is rotatable on the original position and pivotally connected to the insertion hole of the seat and the limit hole of the support leg.

Each of the pressing blocks is engaged with the threaded rod by threads and rotatable between a folded position and an extended position. When the pressing block is at the folded position, it is allowed to pass through the mounting hole of the tabletop from top to bottom. By rotation of the threaded rod, the pressing block is rotated to the extended position and limited by the adjacent rotation limit rod. With continuous rotation of the threaded rod, the pressing block is moved upward along the threaded rod and further pressed on a bottom surface of the tabletop around the mounting hole tightly.

Preferably, the seat is further provided with a circular wall and a bottom wall is formed inside the circular wall. The mounting though hole is formed inside the circular wall and located adjacent to the bottom wall. The insertion holes are arranged at the bottom wall. A top of the rotation limit rod of the support leg is connected to the bottom wall.

Preferably, the faucet support assembly further includes two limit covers each of which is mounted to a bottom end of the threaded rod under the separation portion. Thereby the threaded rod is limited and unable to move upward and come off.

Preferably, the faucet support assembly further includes a waterproof gasket; a circular press wall is formed on the bottom of the seat and the waterproof gasket is clipped and pressed tightly between the circular press wall and the top surface of the tabletop around the mounting hole.

Preferably, the two limit holes are located at two sides of the closed separation hole correspondingly.

Preferably, the top of the rotation limit rod is integrally connected to the bottom of the seat.

Preferably, two sides of the separation portion are integrally connected to a bottom of the rotation limit rods.

Preferably, the top of the rotation limit rod is connected and fixed on the bottom of the seat.

Preferably, two sides of the separation portion are connected and fixed on the bottom of the rotation limit rods.

Preferably, the separation hole is a closed hole.

Preferably, the separation hole is an open hole with a notch.

Preferably, by the separation hole with complete closed design or open design, the pull-out tube under the faucet inserted through the separation hole can be separated from the rest of the water pipelines including a cold-water intake pipe, a hot-water intake pipe, and a mixed water discharge pipe completely. Thus contact and collision of the pull-out tube with the rest of the water pipelines can be avoided and the manually-operated spray head of the faucet can be operated smoothly in a labor-saving manner and service life of the respective water pipelines is extended.

The rotation limit rods of the support leg are extending downward from the bottom of the seat and the bottoms of the rotation limit rods are integrally connected by the separation portion. Thereby the support leg has excellent structural strength to avoid deformation or damages caused by collision. Similarly, the threaded rod pivotally connected to the seat and the support leg also gets good support and protection, without being deformed or damaged easily during collision. Therefore, the pressing blocks can be moved upward and downward along the threaded rods smoothly as well as attached to and pressed on the bottom surface of the tabletop firmly.

DETAILED DESCRIPTION

Figure 1:
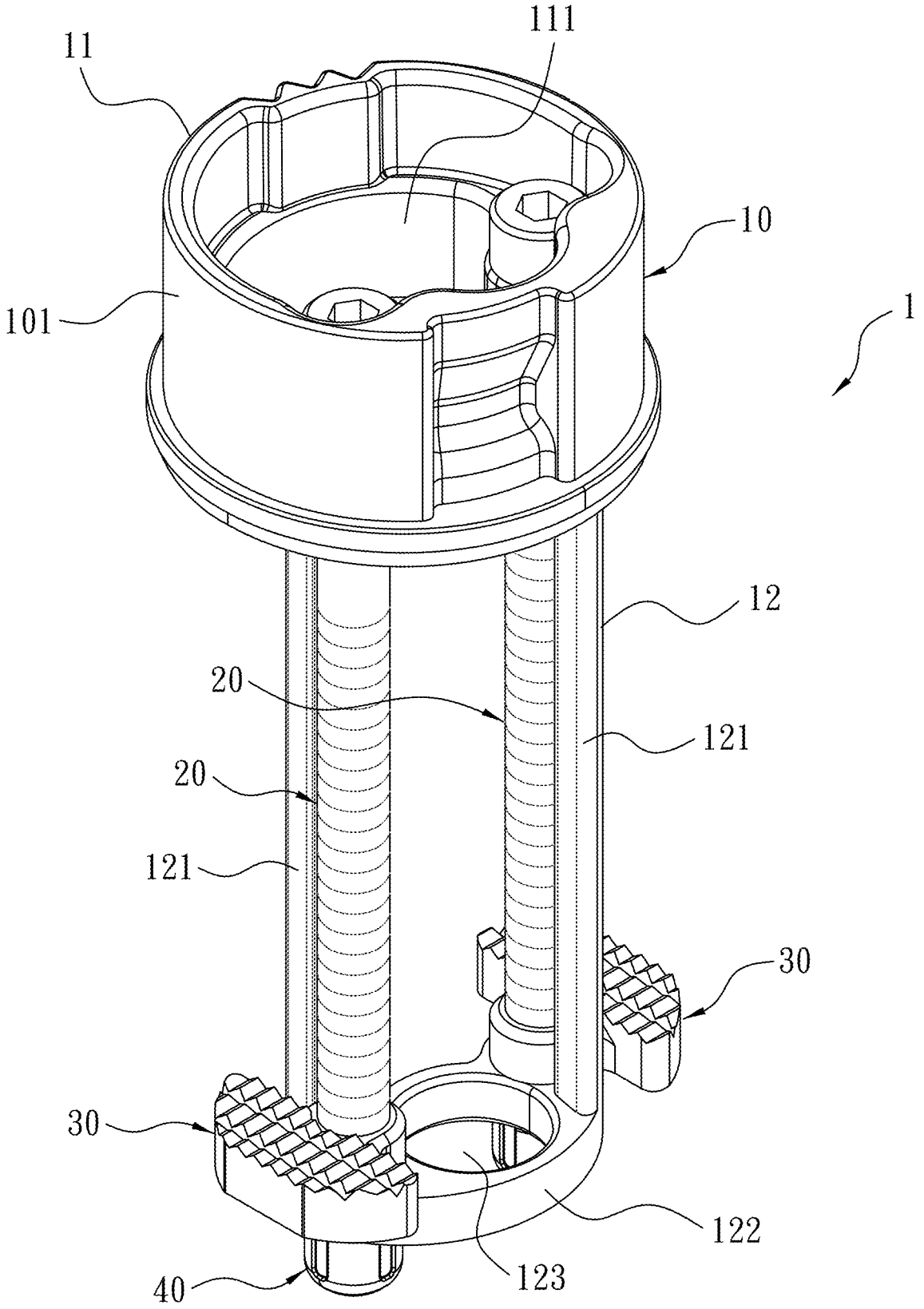
FIG. 1 is a perspective view of an embodiment of a faucet support assembly according to the present invention.
Figure 2:
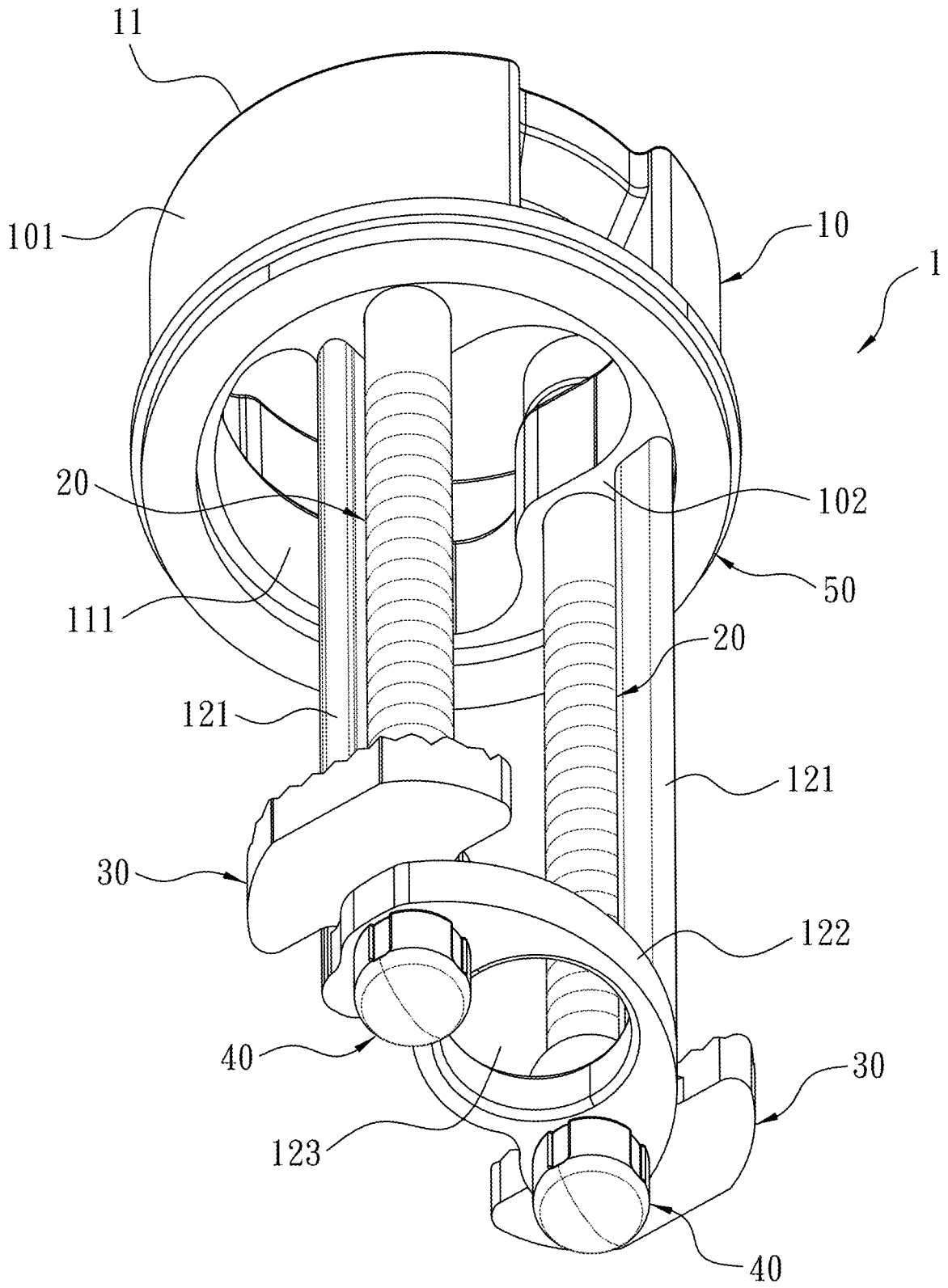
FIG. 2 is another perspective view of an embodiment of a faucet support assembly according to the present invention.

Please refer to the following embodiments and related figures for further details.

Refer to FIG. 1-6, a faucet support assembly for faucets is provided. In this embodiment, a faucet support assembly 1 is installed on a tabletop 2 for mounting and fixing a faucet with water pipelines under the faucet. The tabletop 2 is provided with a mounting hole 2*a*. The faucet support assembly 1 includes a support member 10, two threaded rods 20, and two pressing blocks 30.

The support member 10 consists of a seat 11 mounted on a top surface 2*b* of the tabletop 2 around the mounting hole 2*a* and a support leg 12 integrally extending downward from a bottom of the seat 11 and passed through the mounting hole 2*a*. The seat 11 is provided with a mounting though hole 111 and two insertion holes 112. The support leg 12 consists of two rotation limit rods 121 each of which having a top integrally connected to the seat 11, a separation portion 122 integrally connected to and located between bottoms of the rotation limit rods 121, a closed separation hole 123 defined by the separation portion 122, and two limit holes 124 each of which is located adjacent to the corresponding rotation limit rod 121 and defined by the separation portion 122. It is clear that the two limit holes 124 are located about at two sides of the separation hole 123 correspondingly.

The threaded rod 20 is pivotally connected to the insertion hole 112 of the seat 11 and the limit hole 124 of the support leg 12 in a rotatable manner.

The pressing block 30 is engaged with the threaded rod 20 by threads and rotatable between a folded position and an extended position. As shown in FIG. 5-8, when the pressing block 30 is at the folded position, it is allowed to pass through the mounting hole 2*a* of the tabletop 2 from top to bottom. By rotation of the threaded rod 20, the pressing block 30 is rotated to the extended position and limited by the adjacent rotation limit rod 121. With continuous rotation of the threaded rod 20, the pressing block 30 is moved upward along the threaded rod 20 and further pressed on a bottom surface 2*c* of the tabletop 2 around the mounting hole 2*a* tightly.

In this embodiment, the seat 11 is further provided with a circular wall 101 and a bottom wall 102 formed inside the circular wall 101. The mounting though hole 111 is formed inside the circular wall 101 and located adjacent to the bottom wall 102. The insertion holes 112 are arranged at the bottom wall 102. A top of the rotation limit rod 121 of the support leg 12 is integrally connected to the bottom wall 102.

In this embodiment, the faucet support assembly 1 further includes two limit covers 40 each of which is mounted to a bottom end of the threaded rod 20 under the separation portion 122. Thereby the threaded rod 20 is limited and unable to move upward and come off.

Figure 3:
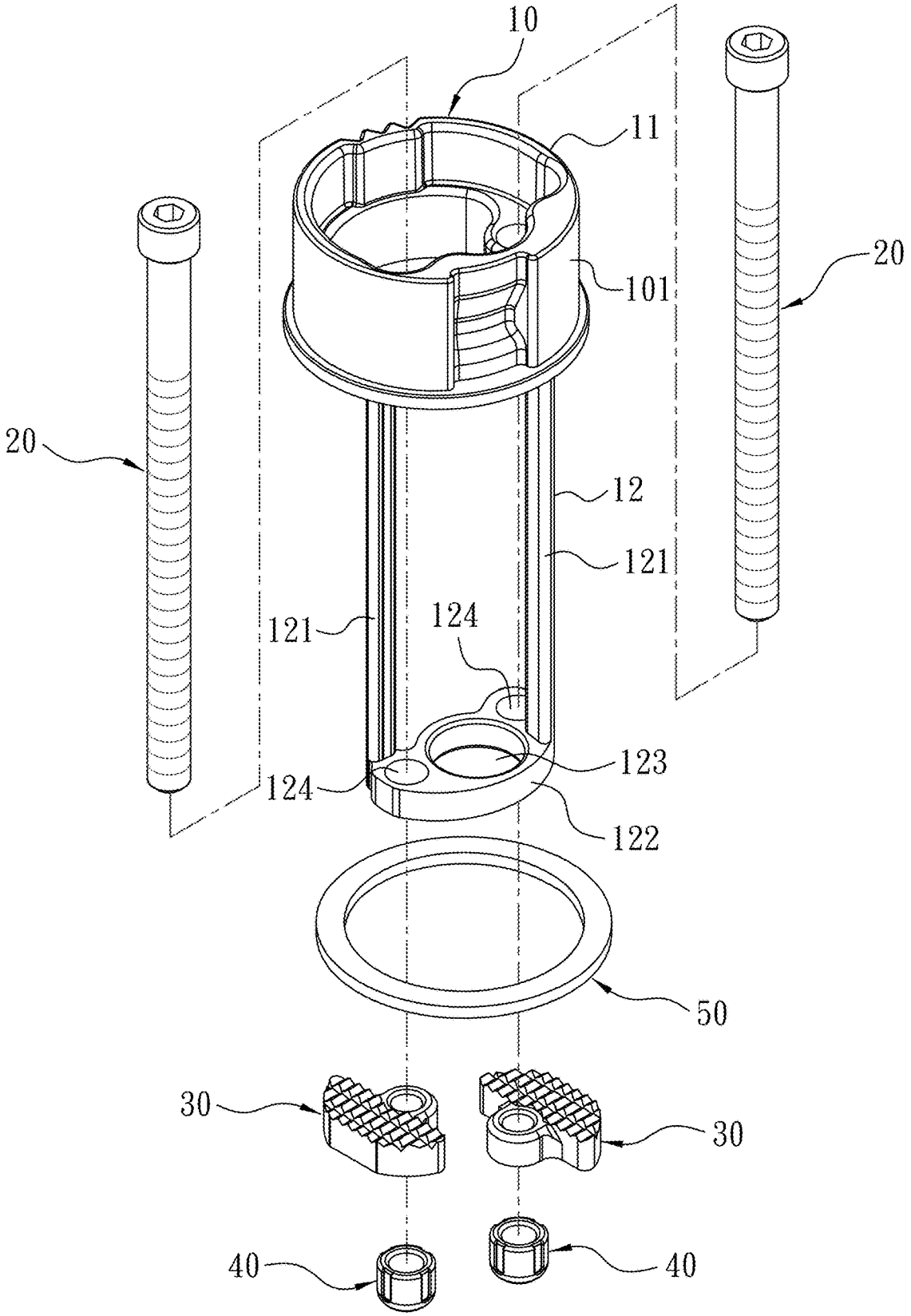
FIG. 3 is an exploded view of an embodiment of a faucet support assembly according to the present invention.
Figure 4:
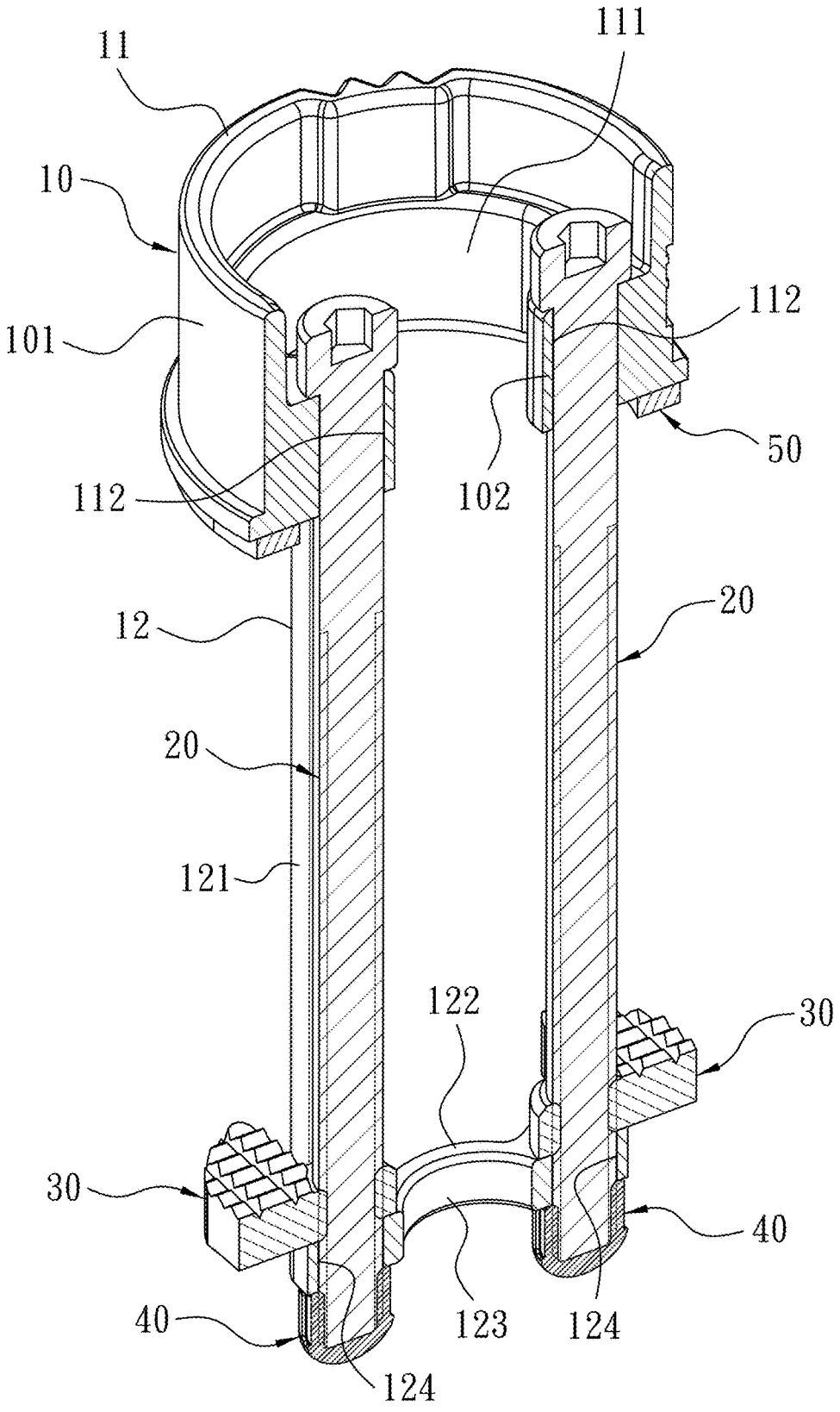
FIG. 4 is a longitudinal sectional view along a center of respective threaded rods of the embodiment in FIG. 1 according to the present invention.
Figure 6:
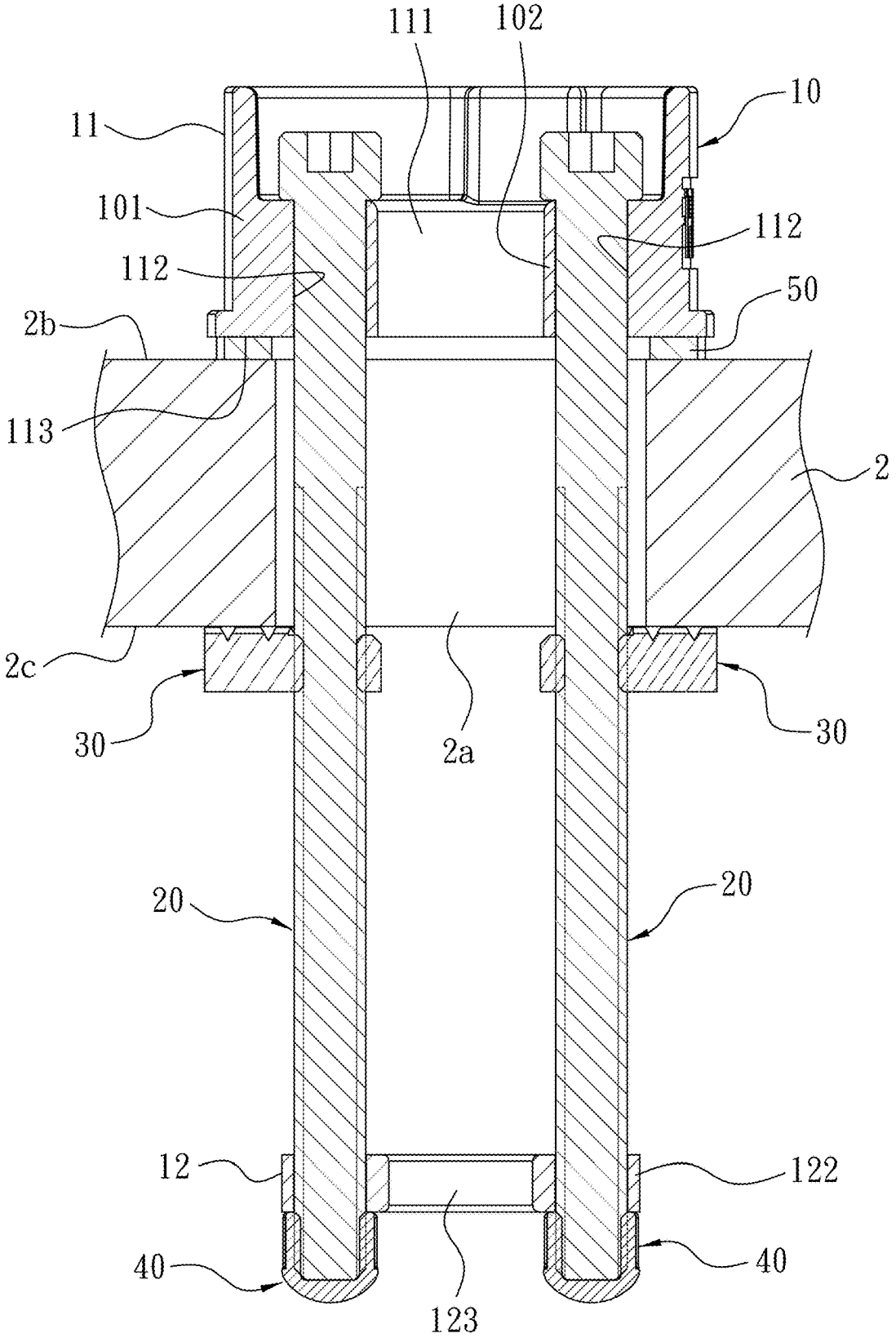
FIG. 6 is a longitudinal sectional view of an embodiment of a faucet support assembly in which pressing blocks at an extended position are pressed on a bottom surface of a tabletop around a mounting hole after being moved upward along threaded rods according to the present invention.

As shown in FIG. 3 and FIG. 6, in this embodiment, the faucet support assembly 1 further includes a waterproof gasket 50. A circular press wall 113 is formed on the bottom of the seat 11 and the waterproof gasket 50 is clipped and pressed tightly between the circular press wall 113 and the top surface 2*b* of the tabletop 2 around the mounting hole 2*a*.

Thereby waterproofing and sealing effect between the seat 11 and the top surface 2*b* of the tabletop 2 is ensured.

Figure 5:
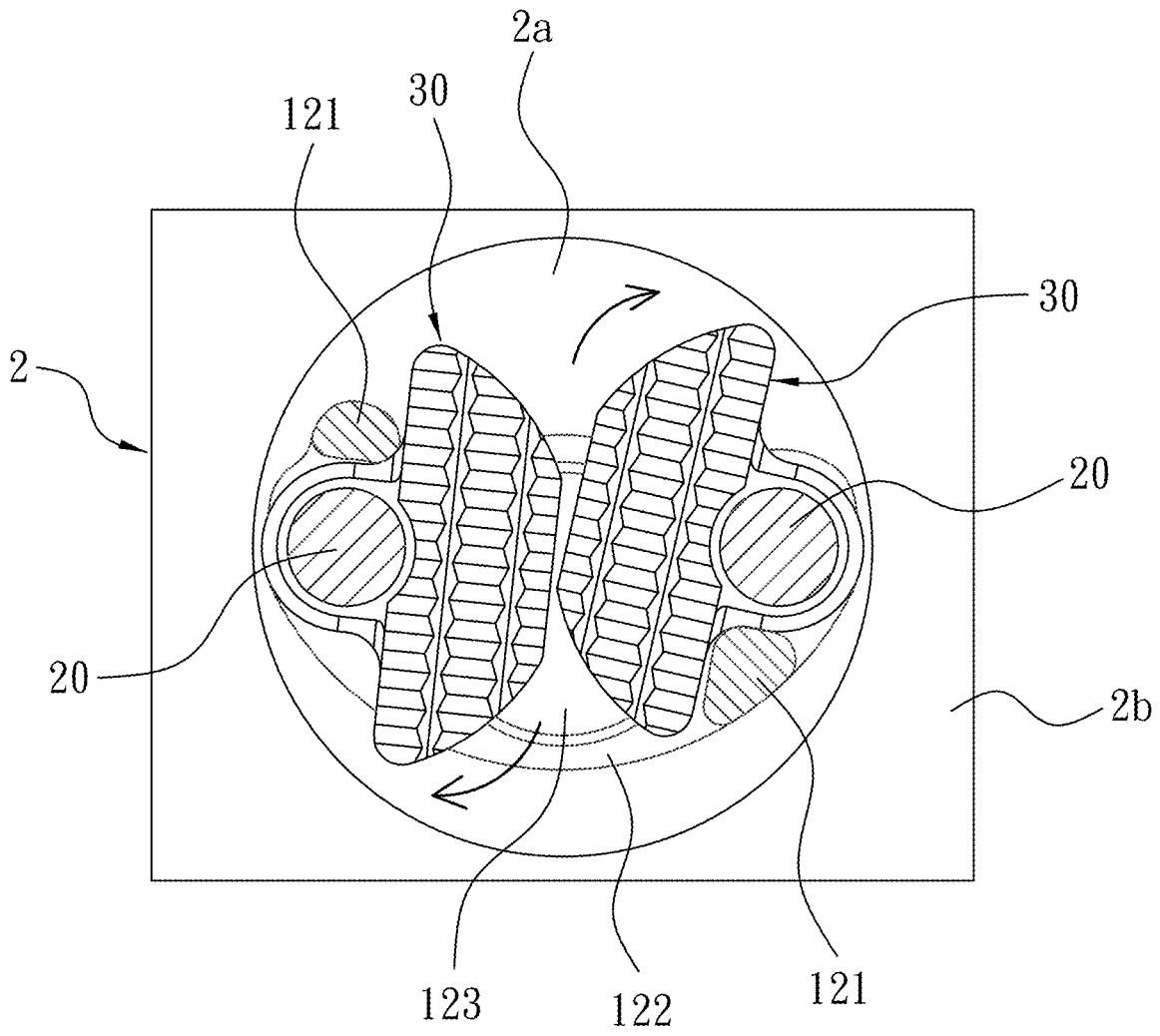
FIG. 5 is a schematic drawing showing pressing blocks of a faucet support assembly at a folded position being rotated toward an extended position after passed through a mounting hole of a tabletop of an embodiment according to the present invention.

In this embodiment, the faucet support assembly 1 is installed on the tabletop 2. During assembly, installers can rotate the threaded rods 20 to drive the pressing blocks 30 or directly push the pressing blocks 30 to be rotated to and positioned at the folded position, as shown in FIG. 5. Then the support leg 12 of the support member 10 together with the threaded rods 20 and the pressing blocks 30 assembled thereon is inserted through the mounting hole 2*a* of the tabletop 2 from top to bottom until the bottom of the seat 11 of the support member 10 or the waterproof gasket 50 under the bottom of the seat 11 is leaning against the top surface 2*b* of the tabletop 2 around the mounting hole 2*a*. Thereby preliminary installation is completed. Then the respective threaded rods 20 are rotated to drive the pressing blocks 30 rotating until leaning against the adjacent rotation limit rods 121. Now the pressing blocks 30 are at the extended position. It is easy to understand that the pressing block 30 has sufficient width for following leaning and pressing after being extended. When users continue rotating the threaded rods 20, the pressing blocks 30 are stopped by the adjacent rotation limit rods 121 and unable to continue rotating. Thus the pressing blocks 30 are only able to move upward along the threaded rods 20 until it's abutting against and pressed on the bottom surface 2*c* of the tabletop 2 around the mounting hole 2*a* tightly. As shown in FIG. 6, the faucet support assembly 1 is pressed and fixed on the mounting hole 2*a* of the tabletop 2 and assembly of the faucet support assembly 1 is finished.

Figure 7:
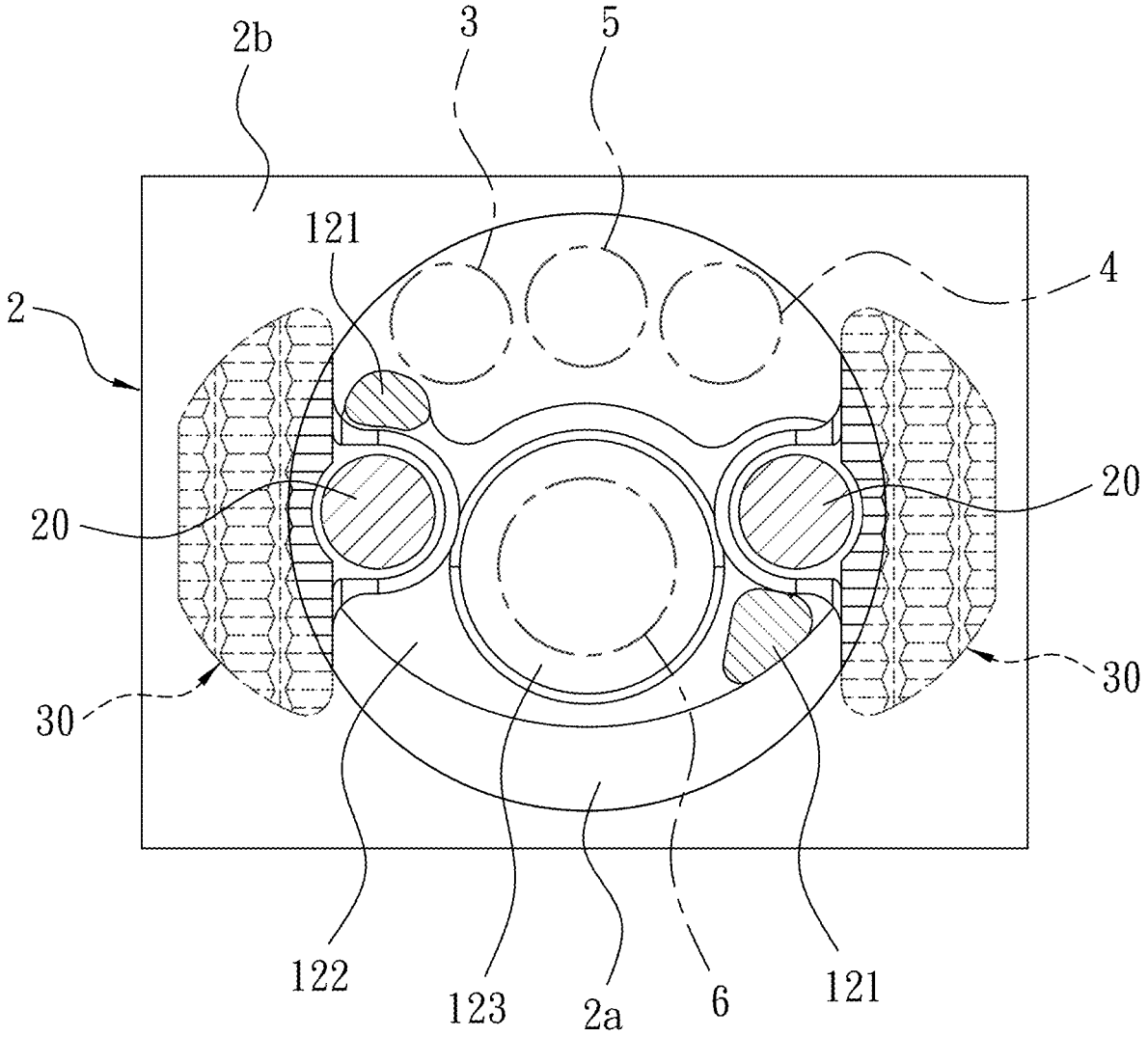
FIG. 7 is a sectional view showing imaginary water pipelines of a faucet, including a cold-water intake pipe, a hot-water intake pipe, a mixed water discharge pipe, and a pull-out tube inserted through a mounting hole and a separation hole after an embodiment installed on a tabletop according to the present invention.
Figure 8:
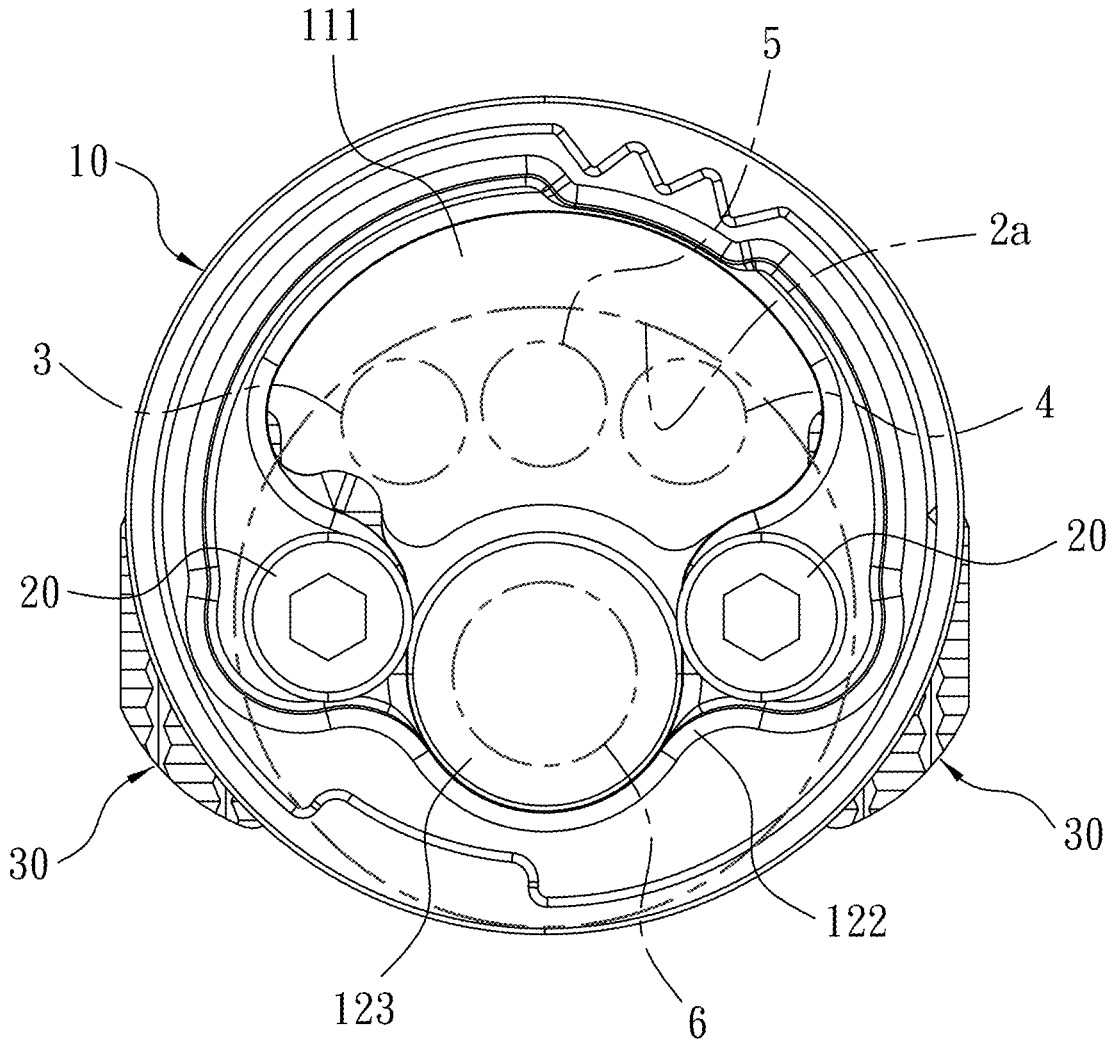
FIG. 8 is a sectional view showing positions of the imaginary water pipelines with respect to the mounting hole of the embodiment in FIG. 7 according to the present invention.

After finishing the assembly of the faucet support assembly 1, installation of various types of faucets is carried out, especially a pull-out faucet or a pull-down faucet. Generally, the pull-out or pull-down faucet includes a spray head able to be pulled out and extended manually, and four water pipelines disposed under the faucet. The four water pipelines consist of a cold-water intake pipe 3, a hot-water intake pipe 4, a mixed water discharge pipe 5, and a pull-out tube 6. During installation, a bottom end of the respective water pipelines under the faucet is inserted through the mounting though hole 111 of the support member 10 in a downward direction. It should be noted that the installers can especially align the pull-out tube 6 with the separation hole 123 and insert the pull-out tube 6 through the separation hole 123 while the rest of the water pipelines are passed through a space outside the separation hole 123 in the downward direction, as shown in FIG. 7 and FIG. 8. The above design has an advantage in that the pull-out tube 6 is effectively separated from the rest of the water pipelines, without contact and collision with the rest of the water pipelines.

The pull-out tube 6 of the pull-out faucet or the pull-down faucet can be moved upward and downward along with user's manual operation and the release of the spray head while the rest of the water pipelines remain still, without being moved vertically. Thus by the separation of the pull-out tube 6 from the rest water pipelines including the cold-water intake pipe 3, the hot-water intake pipe 4, and the mixed water discharge pipe 5 mentioned above, contact and collision of the pull-out tube 6 with the rest of the water pipelines can be avoided. Thus not only smooth and more labor-saving manual operation is ensured, service life of the respective water pipelines is also increased.

Moreover, the rotation limit rods 121 of the support leg 12 are integrally extending from the bottom of the seat 11 and the bottoms of the rotation limit rods 121 are integrally connected by the separation portion 122. Thereby the support leg 12 has excellent structural strength. Once the rotation limit rod 121 is accidentally bumped, it will not get curved, deformation, tilting or damages easily. The threaded rod 20 pivotally connected to the seat 11 and the support leg 12 also gets good support and protection, without being deformed or damages easily while being collided. Therefore, the pressing blocks 30 can be moved upward and downward along the threaded rods 20 smoothly as well as attached to and pressed on the bottom surface 2*c* of the tabletop 2 firmly.

Figure 9:
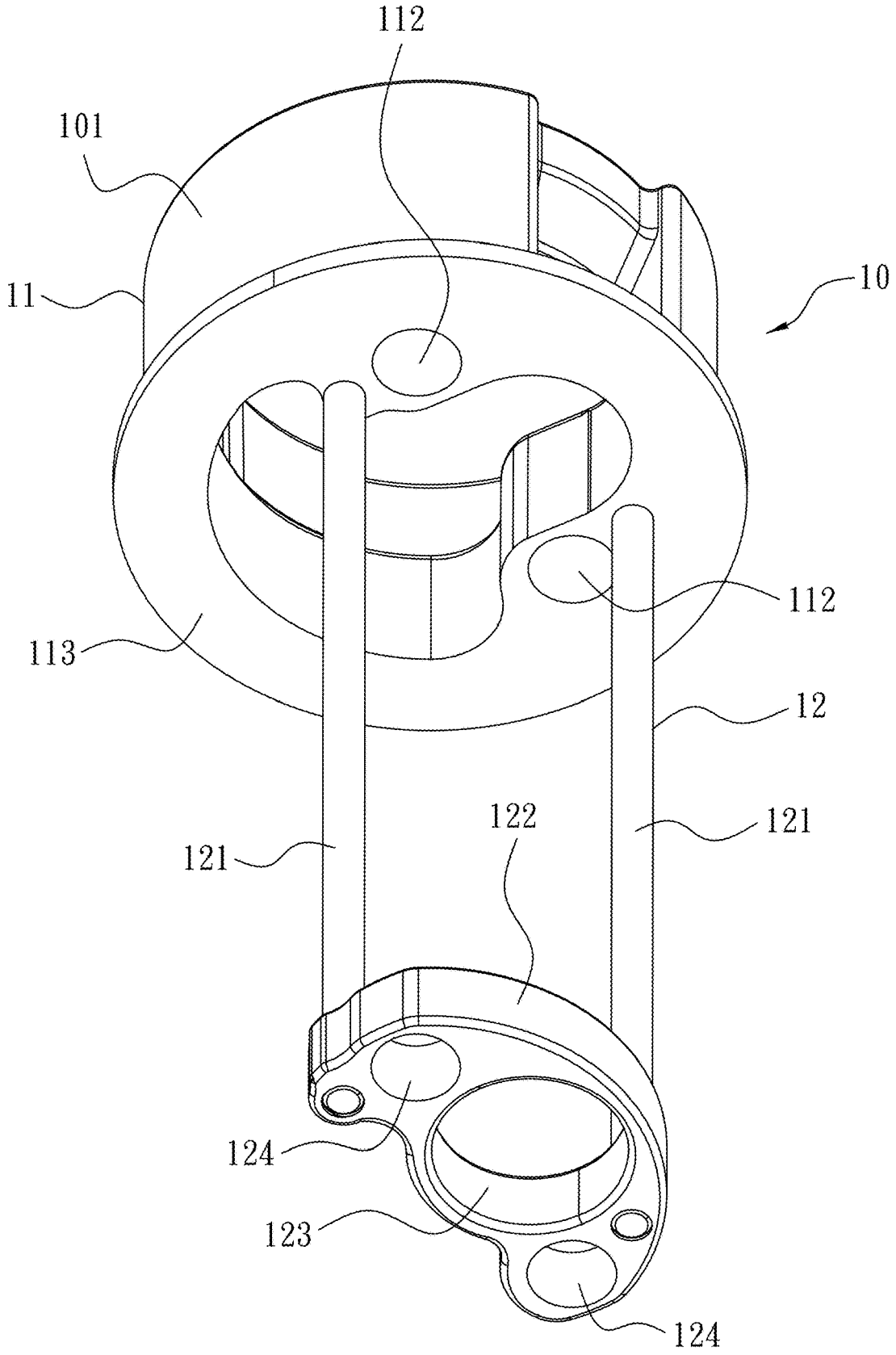
FIG. 9 is a perspective view of another embodiment of a faucet support assembly according to the present invention.
Figure 10:
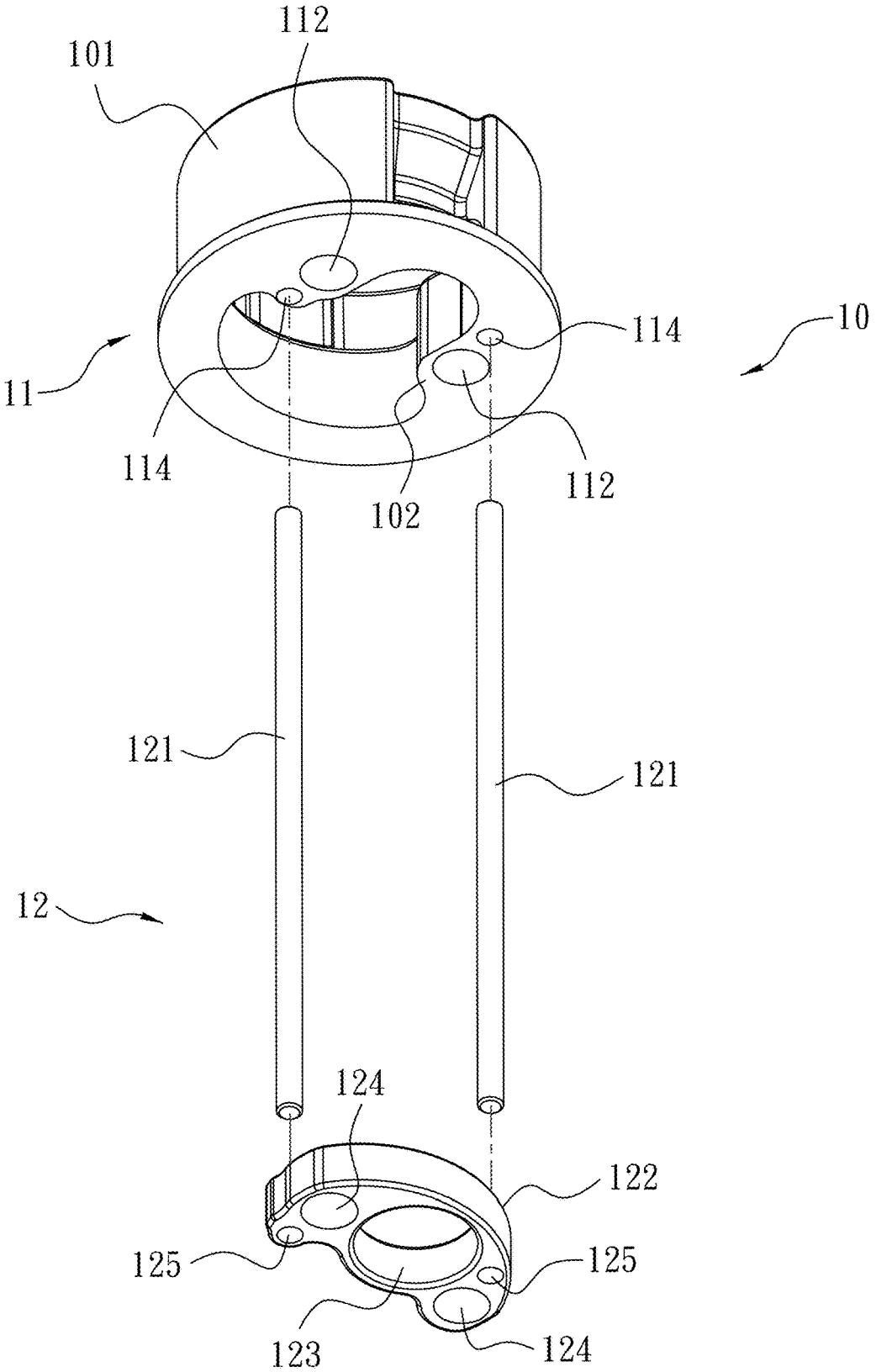
FIG. 10 is an exploded view of the embodiment in FIG. 9 according to the present invention.

It should be noted that the top of the rotation limit rod 121 of the support leg 12 is integrally formed on the bottom of the seat 11, but not limited. The assembly design can also be adopted. For example, refer to FIG. 9 and FIG. 10, the bottom wall 102 of the seat 11 is provided with two connection holes 114 through which the top of the rotation limit rod 121 is inserted and fixed therein. Similarly, integration of the two sides of the separation portion 122 with the rotation limit rods 121 can also be changed into assembly design. For example, each of the two sides of the separation portion 122 is provided with a connection hole 125 through which the bottom of the seat 11 is inserted and fixed therein. Thereby the structure of complex parts is simplified and cost for mold opening is reduced.

Figure 11:
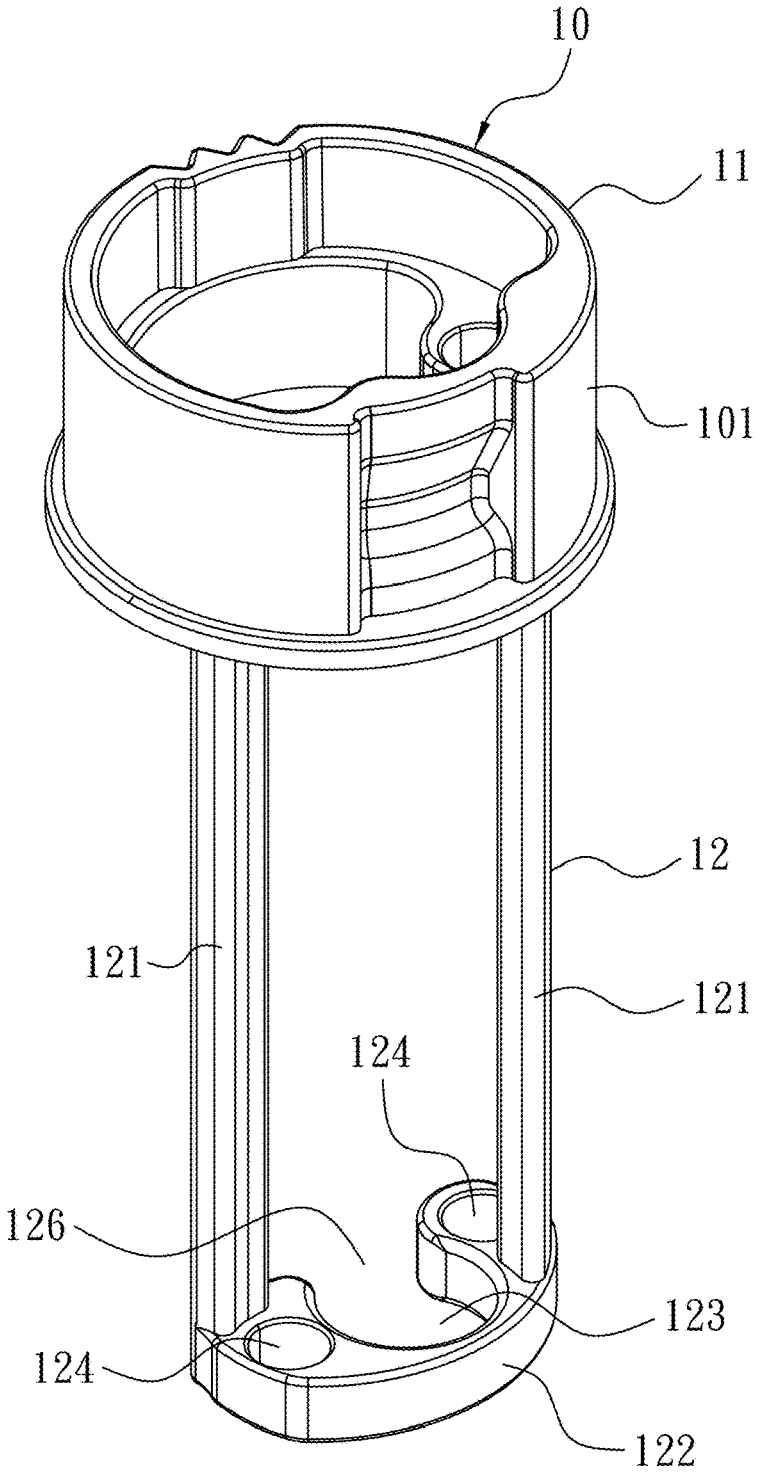
FIG. 11 is a perspective view of a further embodiment of a faucet support assembly according to the present invention.

The above separation hole 123 of the separation portion 122 is designed into a closed hole used for allowing the pull-out tube 6 to pass through and ensuring that the pull-out tube 6 is separated from the rest water pipelines passed through the space beside the separation hole 123. Thus the contact and collision of the pull-out tube 6 with the rest of the water pipelines can be avoided. In practice, some types of the faucets have the pull-out tube 6 with larger size so that it is feasible that the separation hole 123 is designed into an open hole. As shown in FIG. 11, a notch 126 formed in the design of the open hole allows a small part of the pull-out tube 6 to be mounted therein. Since a width of the notch 126 is smaller than the pull-out tube 6, it is still ensured that the pull-out tube 6 is limited and isolated in the open-type separation hole 123. Thereby the purpose of effective separation of the pull-out tube 6 with the rest of the water pipelines can be achieved. Although the separation hole 123 is mainly used for allowing the pull-out tube 6 to pass through, the rest water pipelines such as various types of water inlet pipes may still pass through the separation hole 123. The installation and proper separation of the water pipelines can still be achieved.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

The invention claimed is:

1. A faucet support assembly installed on a tabletop with a mounting hole and comprising a support member, two threaded rods, and two pressing blocks;

wherein the support member consists of a seat mounted on a top surface of the tabletop around the mounting hole and a support leg extending downward from a bottom of the seat and passed through the mounting hole; the seat is provided with a mounting though hole and two insertion holes; the support leg is provided with two rotation limit rods each of which having a top connected to the seat, a separation portion connected to and located between bottoms of the rotation limit rods, a separation hole defined by the separation portion, and two limit holes each of which is located adjacent to the corresponding rotation limit rod and defined by the separation portion;

wherein each of the threaded rods is rotatable and pivotally connected to the corresponding insertion hole of the seat and the corresponding limit hole of the support leg; and wherein each of the pressing blocks is engaged with the corresponding threaded rod by threads and rotatable between a folded position and an extended position; the pressing block is allowed to pass through the mounting hole of the tabletop from top to bottom when the pressing block is at the folded position; the pressing block is rotated to the extended position by rotation of the threaded rod and limited by the adjacent rotation limit rod; with continuous rotation of the threaded rod, the pressing block is moved upward along the threaded rod and further pressed on a bottom surface of the tabletop around the mounting hole tightly.

2. The faucet support assembly as claimed in claim 1, wherein the seat is provided with a circular wall and a bottom wall is formed inside the circular wall; the mounting though hole is located adjacent to the bottom wall; the insertion holes are arranged at the bottom wall and a top of the rotation limit rod of the support leg is connected to the bottom wall.

3. The faucet support assembly as claimed in claim 1, wherein the faucet support assembly further includes two limit covers each of which is mounted to a bottom end of the threaded rod under the separation portion so that the threaded rod is limited and unable to move upward and come off.

4. The faucet support assembly as claimed in claim 2, wherein the faucet support assembly further includes a waterproof gasket; a circular press wall is formed on the bottom of the seat and the waterproof gasket is clipped and pressed tightly between the circular press wall and the top surface of the tabletop around the mounting hole.

5. The faucet support assembly as claimed in claim 1, wherein the two limit holes are located at two sides of the separation hole correspondingly.

6. The faucet support assembly as claimed in claim 1, wherein a top of the rotation limit rod is integrally connected to the bottom of the seat.

7. The faucet support assembly as claimed in claim 6, wherein two sides of the separation portion are integrally connected to a bottom of the rotation limit rods.

8. The faucet support assembly as claimed in claim 1, wherein a top of the rotation limit rod is connected and fixed on the bottom of the seat.

9. The faucet support assembly as claimed in claim 8, wherein two sides of the separation portion are connected and fixed on a bottom of the rotation limit rods.

10. The faucet support assembly as claimed in claim 1, wherein the separation hole of the separation portion is a closed hole.

11. The faucet support assembly as claimed in claim 1, wherein the separation hole of the separation portion is an open hole provided with a notch.

* * * * *